United States Patent [19]

Ball et al.

[11] 4,224,769

[45] Sep. 30, 1980

[54] SPACE DIVIDER SYSTEM

[75] Inventors: Douglas C. Ball, Senneville; Marshall Walker, Waterloo, both of Canada

[73] Assignee: Hauserman Limited, Waterloo, Canada

[21] Appl. No.: 914,713

[22] Filed: Jun. 12, 1978

[51] Int. Cl.[2] ..... E04H 1/00

[52] U.S. Cl. ..... 52/36; 52/221; 52/238; 312/140.1

[58] Field of Search ..... 52/36, 221, 238, 239, 52/236.7; 312/140.1; 35/60

[56] References Cited

U.S. PATENT DOCUMENTS

| | | | |
|---|---|---|---|
| 2,000,243 | 5/1935 | Manske | 52/221 X |
| 3,449,877 | 6/1969 | Beckman | 52/238 |
| 3,552,042 | 1/1971 | Rabineau | 35/60 |
| 3,559,352 | 2/1971 | Magnuson | 52/36 |
| 3,883,202 | 5/1975 | Konig | 312/223 |
| 3,949,827 | 4/1976 | Witherspoon | 52/239 X |
| 4,015,397 | 4/1977 | Flachbarth et al. | 52/221 X |
| 4,038,796 | 8/1977 | Eckel | 52/221 |
| 4,056,903 | 11/1977 | Guarnere | 52/239 X |

FOREIGN PATENT DOCUMENTS

| | | | |
|---|---|---|---|
| 2438502 | 3/1976 | Fed. Rep. of Germany . | |
| 919494 | 2/1963 | United Kingdom | 52/221 |

*Primary Examiner*—J. Karl Bell

*Attorney, Agent, or Firm*—Maky, Renner, Otto & Boisselle

[57] ABSTRACT

A space divider system which includes a plurality of posts and at least one beam assembly wherein the posts and beam constitute a raceway for receiving electrical and communication wiring for the transmission of electrical energy at work table height and wherein the posts and beam constitute a rigid structure for supporting various components such as lighting, acoustic panels, table and work surfaces, file storage bins and the like. Means are provided for interconnecting said posts and beam or beams in a manner facilitating the passage of wiring therebetween and addition means are provided within said posts for levelling a beam supported therebetween.

19 Claims, 4 Drawing Figures

20
21
22
35
36
37
38
41
43
51
53
59
65
67
69
71
73
81
82
84
85
86
87
88
95
108
109

SPACE DIVIDER SYSTEM

The present invention relates to a portable space divider structure which is built up of a plurality of post and beams, and, in particular, to a hollow post and beam structure which defines a raceway for electrical wiring and which may serve as a support for work surfaces such as desks and table tops, lighting fixtures, and acoustical elements arranged to constitute partitions.

It has been known to provide wall structures formed of a plurality of prefabricated panels for use in commercial buildings for dividing large interior office regions into smaller working spaces, or task areas. The panels have been formed of acoustic or non acoustic material suitably framed and provided with interconnections to enable the same to be assembled or disassembled to facilitate rearrangement of space as desired.

While these structures have worked well in some instances, these structures nevertheless have in other instances been difficult to service with electrical and communication wiring required for the task areas defined by such partitions. Certain of the wall structures comprised of such panels have required auxiliary raceways to be attached externally of the panels thereby adversely affecting the overall appearance of such wall structures.

Other prior art structures are known which include a plurality of prefabricated panels wherein each panel is prewired and includes power blocks disposed in lower opposite corners of each panel. The power blocks are connected by electrical cables which are received in a raceway at the base of the panel. Electrical power is conveyed between adjacent panels by electrical connectors which are plugged into the power blocks of adjacent panels. This series type of electrical interconnection has proved disadvantageous in that upon the failure of electrical wiring in one panel successively connected panels have become disabled. In addition, in those arrangements where two or more task areas are back to back with respect to each other and are each individually bounded by a common panel or panels, special auxiliary electrical connections have been found necessary to take off electrical power to an abutting task area.

Various attempts have been made to provide prefabricated wall panels which have incorporated electrical sockets and interconnecting wiring, but these prefabricated panels have not served to facilitate quick disassembly and rearrangement of task areas within an office complex.

It is an object of this invention, therefore, to provide an improved portable space divider system which avoids one or more of the disadvantages of the prior-art arrangements and which has improved ease of installation.

It is still another object of this invention to provide an improved space divider structure formed from a plurality of posts and beams which together may facilitate supplying electrical energy and communication wiring to the task areas bounded by the space divider structure.

It is still another object of this invention to provide an improved space divider structure formed from a plurality of posts and beams which constitute a raceway to facilitate supplying electrical energy to the task areas bounded by the space divider structure and wherein said raceway constitutes a structural support for mounting acoustical screen elements, lighting, cabinets and work surfaces.

It is still further object of this invention to provide an improved space divider structure formed from a plurality of posts and beams which constitute a raceway to facilitate the supplying of electrical energy to the task areas bounded by the space divider structure formed from a plurality of post and beam assemblies wherein improved mounting means are provided to interconnect the same and wherein levelling means are associated with each post assembly to enable a beam assembly supported between a pair of post assemblies to assume a horizontal attitude irrespective of any imperfections that might exist in the floor surface upon which the space divider structure is positioned.

For a better understanding of the present invention together with other and further objects thereof, reference is had to the following description taken in connection with the accompanying drawing and its scope will be pointed out in the appended claims.

Figure 1:
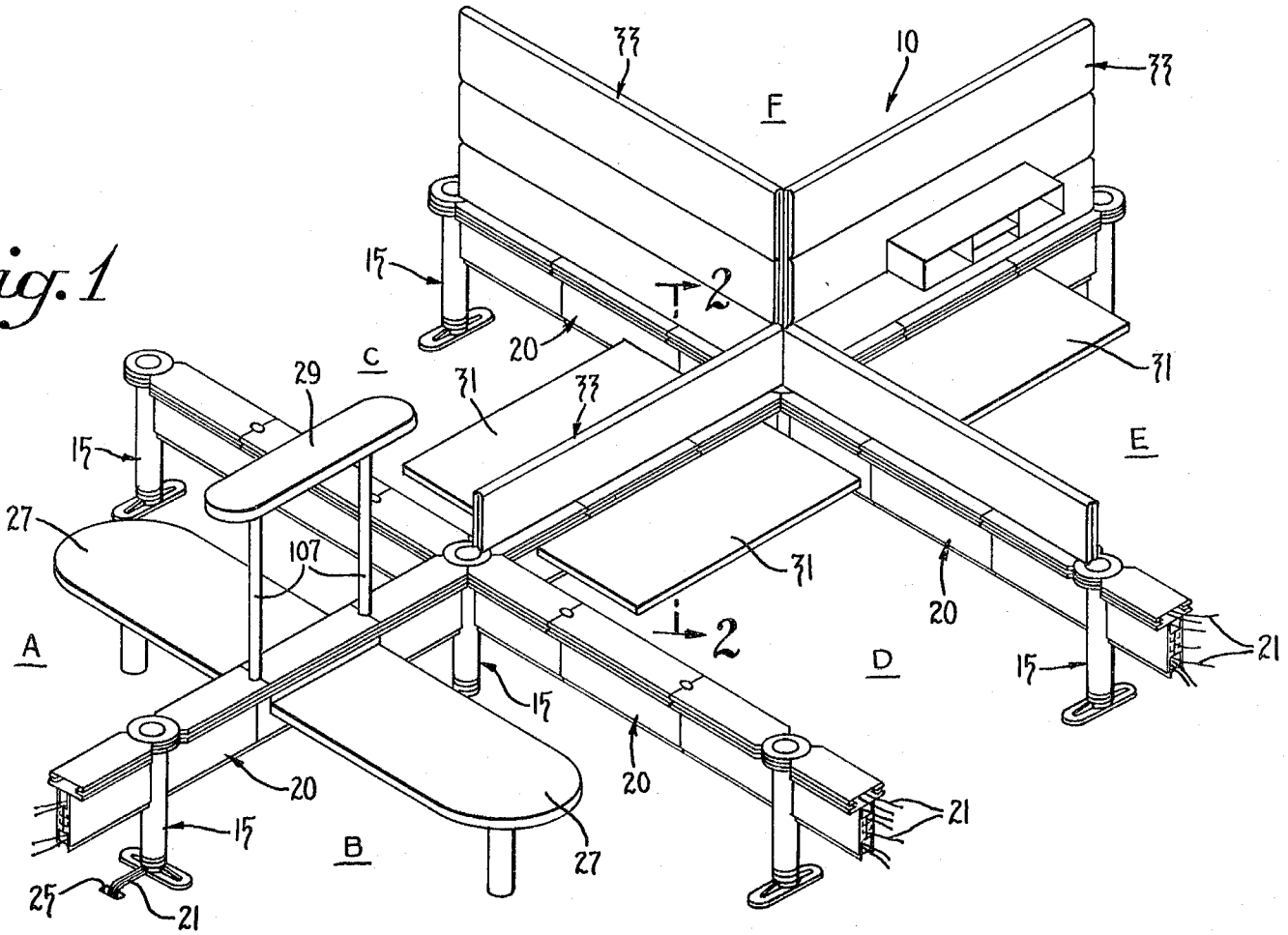
FIG. 1 is a perspective view of a portable space divider system in accordance with the present invention for dividing a large office area into a number of smaller individual work or task areas.

Referring now to FIG. 1 there is shown a space divider system 10 embodying the present invention and includes a plurality of post assemblies 15 which in turn support a plurality of beam assemblies 20 to define a plurality of work stations or task areas indicated at A B C D E and F. Electrical and communication wires 21, shown in the present instance as received from a supply source from below floor level through opening 25 are passed up through post assembly 15 and thereafter layed in the various horizontally disposed raceways of beams defining the boundaries of the task areas A to F inclusive above. The beam assemblies 20 are shown supported above floor level and extend vertical from approximately knee height to work surface height. The post and beam assemblies 15, 20 to be hereinafter described constitute a structural frame or spine which supports various components such as table panels 27, lighting fixtures 29, desk tops 31, and accoustical panels 33 which may be adjustably secured to the beam assemblies 20.

Figure 2:
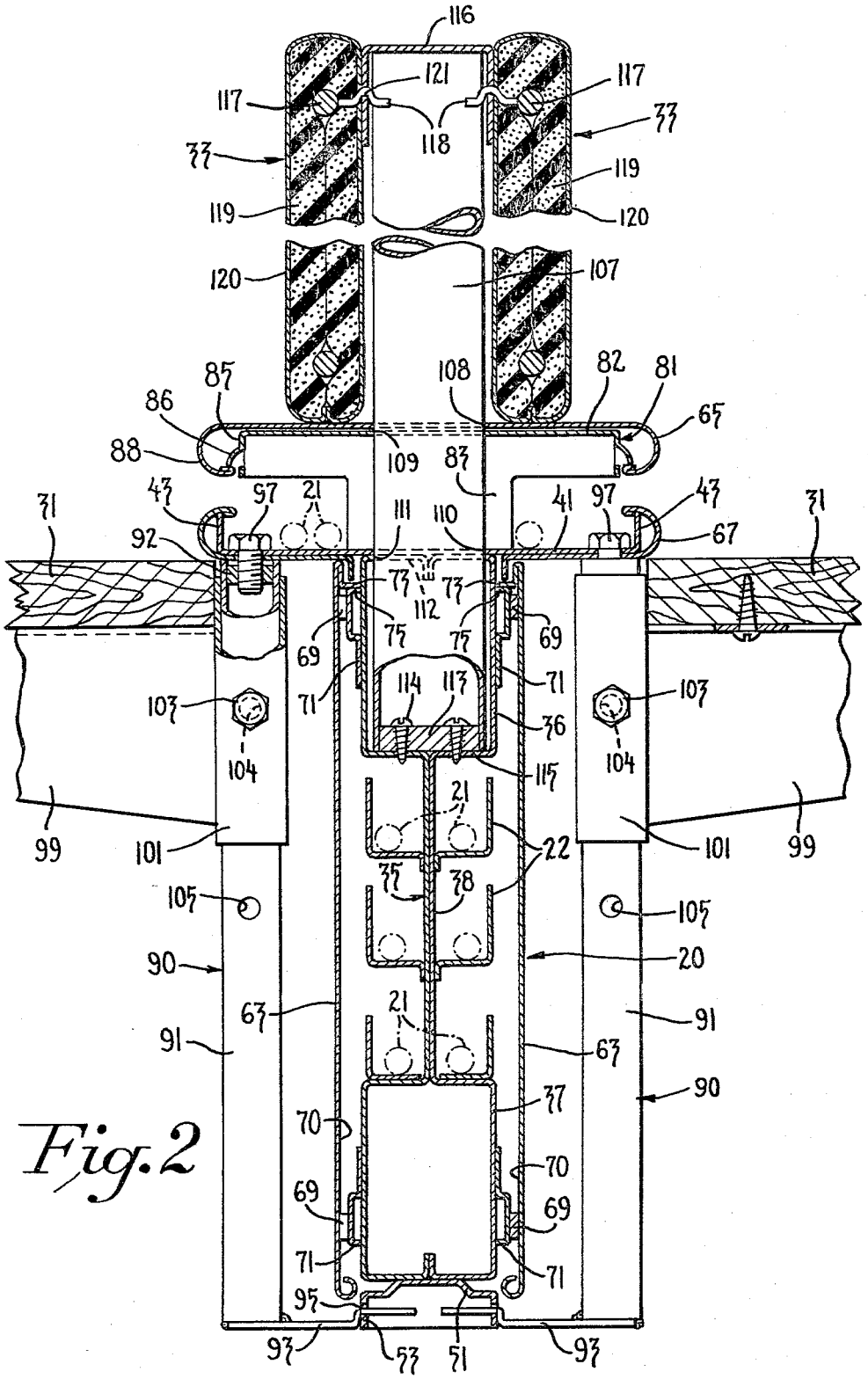
FIG. 2 is an enlarged fragmentary cross-sectional view taken along the lines 2—2 in FIG. 1.
Figure 3:
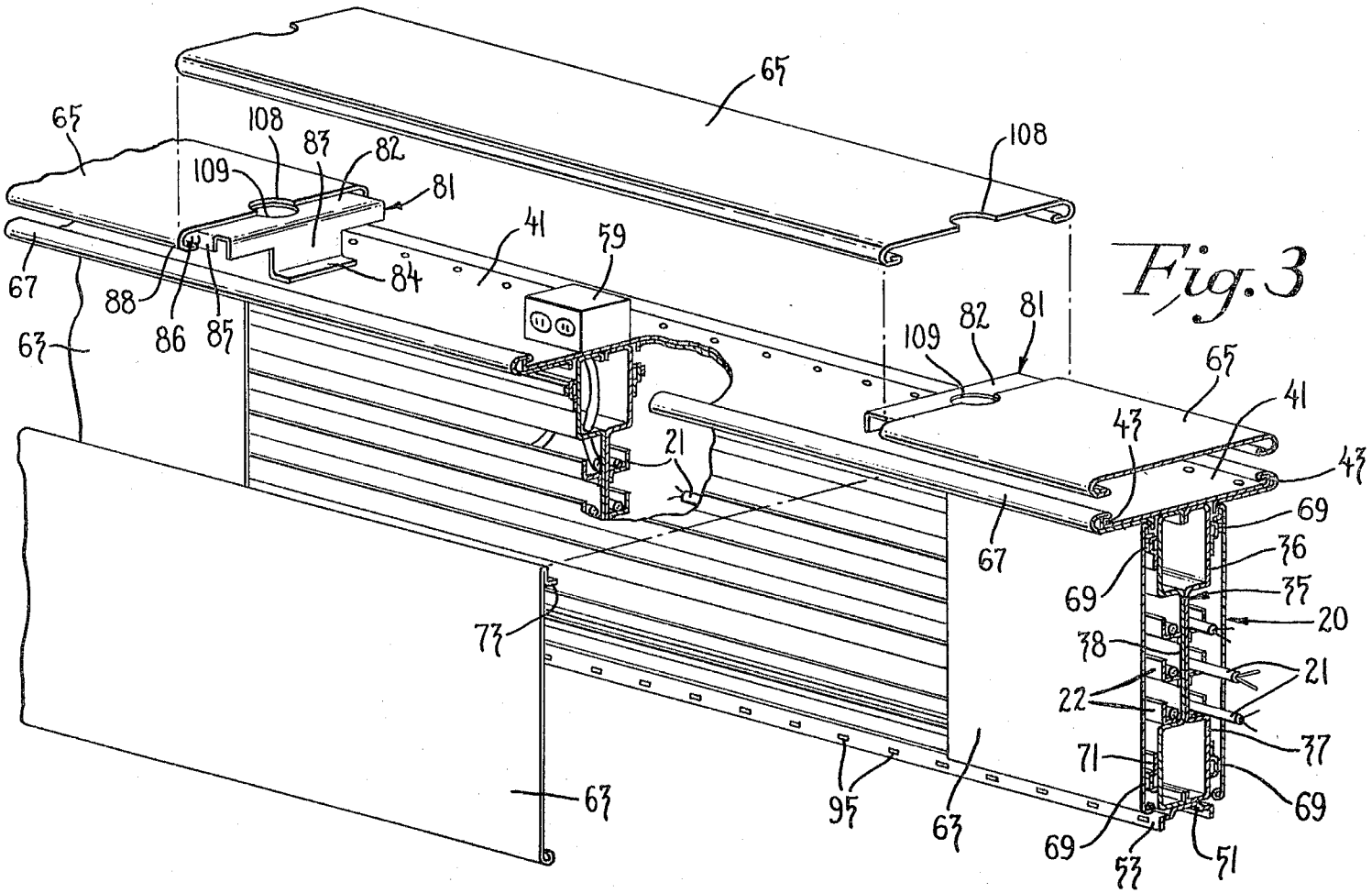
FIG. 3 is an enlarged fragmentary view of a portion of a beam assembly with various covers of the assembly shown in an exploded relationship.

With reference now to FIGS. 2 and 3 the above referred to beam assemblies 20 in the present embodiment of the invention include a centrally disposed I-beam 35 comprising upper and lower closed box sections 36, 37 respectively and interconnected by a vertical web 38. The I-beam is further reinforced to increase its rigidity by means of an upper channel member 41 which includes upturned flanges 43 affixed to the top of the box 36 and an additional channel member 51 having downturned flanges 53 affixed to the lower surface of the lower closed box section 37 of said I-beam. It may be observed that the space between the upper and lower closed box sections 36, 37 and interconnecting vertical web 38 define a raceway for horizontally laying in various electrical and communication wiring 21. In order to separate the electrical and communications wiring a plurality of angle shelf members 22 may be suitably affixed to the web 38 of the I-beam.

With reference to FIG. 3 an electrical outlet box 59 is shown attached to top channel member 41 and is suitably connected with the wiring 21.

Each beam assembly is provided with side panel covers 63 and upper and lower top cover panels 65, 67. As seen in FIG. 2, in order to fasten the side panels 63, magnetic blocks 69 suitably secured to the inner surfaces 70 of the panels. Channel brackets 71 are suitably welded or affixed to the outer side faces of box sections 36, 37. The upper portion of panel 63 includes an inturned flange 73 which when the panel is positioned in place rests on shoulders 75 of the aforementioned channel brackets 71. The magnetic element 69 through magnetic interaction with brackets 71 thereafter operate to urge the top and bottom magnetic elements 69 into engagement with oppositely disposed brackets 71.

Top cover 65 are retained in place by a plurality of brackets 81. The latter brackets 81 include a top support surface 82, downturned leg portions 83, and flanged portions 84 which are suitably secured to top channel 41. The brackets in addition include end flanges 85 having detents 86. Upon urging top cover plate 65 into engagement with bridge brackets 81 the downwardly and inwardly curled edges 88 of the top cover are slightly deformed to snap over the detent 86 of end flange 85.

As previously stated the beam assembly 20 serves as a structural spine to support various components such as desk tops 31 within a given task area. For this purpose cantilever bracket means 90 are provided for engagement with top and bottom portions of the beam assembly 20. The bracket assembly 90 is shown as including a vertical tubular support 91 having a captive nut 92 received within its top end and a foot member 93 affixed to its bottom end and extending inwardly for engagement in a predetermined aperture 95 in downwardly depending flange 53 of channel member 51. A headed bolt 97 is passed through channel plate 41 and bottom cover plate 67 and engages captive nut 92. A bracket arm 99 is fastened along its inner edge to sleeve 101 which encircles post 91 and is slidable vertically and can be fixed at a desired elevation by means of bolt 103 which passes through aligned threaded apertures 104 in sleeve 101 and 105 in tube 91. Inasmuch as flange 53 of channel 51 includes a plurality of elongated apertures 95 (see also FIG. 3) desk 31 may be adjustably shifted along the length of the beam assembly 30.

Still referring to FIG. 2, 1 the previously referred to accoustical panel means 33 may be supported in the manner hereinafter described. A plurality of posts 107, is passed through suitable apertures 108, 109, 110, and 111 in top cover 65, bracket 81, channel 41 and the top wall 112 of closed box section 36 of I-beam 35. A block member 113 is secured on the bottom wall 115 of box section 36 by means of screw elements 114. The post 107 is easily removable by lifting the same vertically and can be reinserted by passing the lower end of the support tube 107 through said aligned apertures 108-111 inclusive and so that block 113 is received within the end of tube 107. The top of the support tube 107 may carry an elongated channel member 116 which bridges adjacent upright tubes and which in turn supports the aforementioned acoustic panel members 33. Each panel member 33 may include a steel rod frame 117 including suitable hook elements 118 projecting therefrom. The panel members may be formed of foam rubber 119 and covered with fabric 120. The hook ends 118 are received in apertures 121 in the downturned flanges of the channel member 116. While the support post 107 in FIG. 2 is shown carrying an acoustical panel, the same alternatively may be used to support an electrical lighting fixture 29 as shown in FIG. 1.

Figure 4:
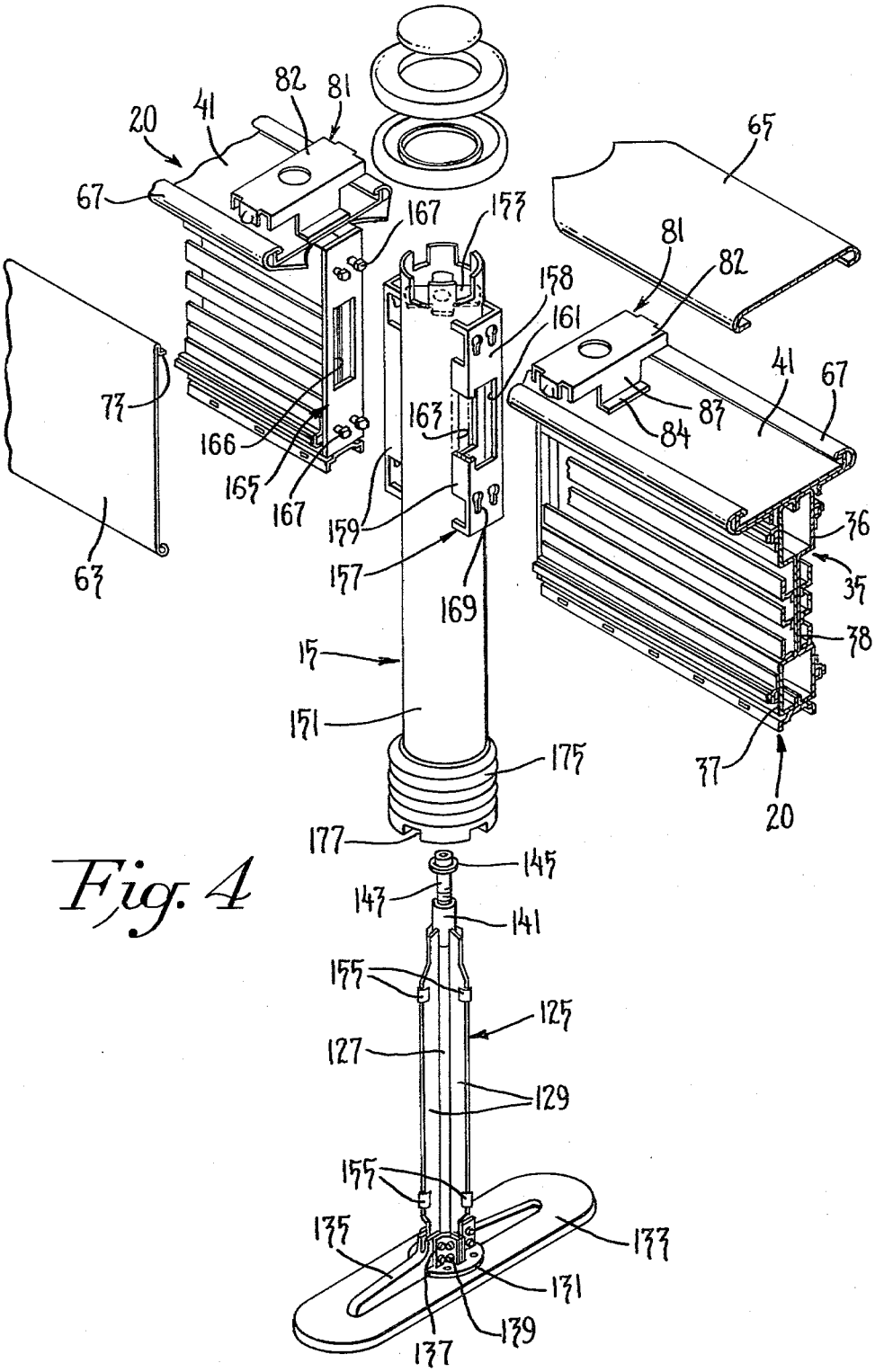
FIG. 4 is an exploded perspective of a typical post assembly manner of interconnecting a plurality of beam assemblies thereto.

With reference now to FIG. 4, the manner by which a post assembly 15 is joined to a beam assembly 20 is illustrated. Referring first to the lower portion of the FIG. 4 post assembly 15 includes leg stiffener means 125 which comprises a tubular leg 127 having a plurality of elongated plate-like stiffener elements 129 secured along one edge to the leg and extending radially outwardly therefrom. The bottom of the leg is suitably affixed as by welding to disc member 131 which in turn may be secured to foot plate 133. A pair of foot members 135 rest on the top surface of foot plate 127 and are secured as by angle brackets 137 to the aforementioned stiffener elements 129, by bolts 139. The top portion of leg 127 includes an internally threaded nut portion 141 which receives a threaded spindle 143 having a cap portion 145 for supporting hollow post member 151.

The above mentioned post 151, includes apertured abutment means 153 adjacent its top portion which extend radially inwardly and which coact with spindle 143 of leg stiffener 125. Post 151 fits around the leg stiffener 127, and plate-like fin elements 129 normally snugly engage the inner wall surfaces of post member 151 by means of the slide elements 155 affixed to the edges of the plates 129 and operate to prevent non-axial movement between the post member 151 and the leg stiffener 125.

Beam assemblies 20 may be assembled to hollow post 151 of post assembly 15 by means of brackets 157. Each bracket 157 is channel shaped in cross section and includes a plate portion 158 and inwardly turned flange portions 159 which may be suitably secured to the external surface of post 151 as by welding. Plate 158 includes a rectangular opening 161 corresponding to the raceway defined by the web 38 and the inner surfaces of upper and lower box sections 36, 37 of I-beam 35. Hollow post 151 likewise includes an opening 163 aligned with opening 161 in plate 158. Each end of I-beam 35 terminates and has affixed thereto an end plate 165 which likewise includes a rectangular opening 166 aligned with opening 163 and the plate in addition has threaded therein a plurality of headed bolts 167 which are aligned with key hole slots 169 in complemental bracket 157. In the assembly process beam assembly 20 may be shifted toward the vertical axis of hollow post 151 to cause the headed ends of bolts 167 to enter the key hole slots 169. Thereafter the bolts may be snugged down by tightening and a leveling instrument may be applied to the top surface of channel 41 to determine if the beam is level. If not, a suitable wrench may be applied to head 145 of spindle 143 and the same turned in a direction until a level state is obtained. A boot 175, of flexible elastomeric material, is suitably affixed to the lower periphery of post 151, and includes cutout portions 177 around its bottom edge to enable easy entry of the wiring 21 up the post and into the beams as indicated in FIG. 1.

While in FIG. 4 only two beams are shown joined to the post assembly, it is apparent that an additional beam or beams could be secured thereto in a plane normal to that containing the two beam assemblies shown in said figure. In this latter instance, additional apertures and mounting brackets would be required for the post assemblies.

From the foregoing it is seen that the above described space divider system enables electric wiring to be brought up from a supply source (see FIG. 1) and into a plurality of separate channeled beam assemblies which define in-duct feeder lines along the beam and electric energy is made available in outlets at work surface height.

While the preferred embodiment of this invention has been described as above, it will be obvious to those skilled in the art that various changes and modifications may be made therein without departing from the invention, and it is, therefore, aimed in the appended claims to cover all such changes and modifications as fall within the true spirit and scope of this invention.

What we claim is:

1. In a portable space divider system for dividing office areas into individual task areas, the combination comprising, horizontally disposed beam means, vertical post means disposed at opposite ends of said beam means, means interconnecting said beam means and said post means, said beam means being recessed lengthwise to receive electrical wiring, and said post means and said connecting means being formed to enable passage of said electrical wiring therethrough, said beam means including an I-beam having upper and lower box portions interconnected by a vertical central web portion to define longitudinal side recesses for reception of said wiring, side plates, and means for mounting said side plates to said beams.

2. In the space divider system as set forth in claim 1 wherein said means for mounting said side cover plates include brackets on said box sections and magnetic means associated with said brackets.

3. In a portable space divider system for dividing office areas into small individual task areas, the combination comprising, beam assembly means, a plurality of post assembly means for supporting opposite ends of said beam assembly at approximately work surface height to form a structural spine, means connecting said post assembly means to said beam assembly means, said beam assembly means supporting passage ways to pass electrical and communication wiring therethrough at substantially such work surface height, said post assembly means including height adjustment spindle means for varying the elevation of one end of said beam assembly means relevant to its opposite end.

4. In the portable space divider system as set forth in claim 3 wherein said assembly is in the general form of an I, having a wiring raceway on top of said I and defining therewith a T, and electrical outlet means at substantially work surface height connected to said wiring in said raceway.

5. In the portable space divider system as set forth in claim 4 including support post means extending upwardly from said structural spine, and frame means extending between said support post means.

6. In the portable space divider system as set forth in claim 5 and including electrical lighting fixtures mounted to said support post means.

7. In the portable space divider system as set forth in claim 5 and including acoustical panel means secured to said frame means and thus supported from said post support means.

8. A portable space divider system as set forth in claim 7, wherein said acoustical panel means are fabric covered sound deadening material forming panels of a generally rectangular configuration and are hung from said frame.

9. A space divider system for office interiors comprising a structural spine, said spine including legs, a beam extending therebetween, the top of said beam being at essentially work surface height, and work surfaces and the like extending horizontally from the beam and at least partially supported thereby.

10. A system as set forth in claim 9 including feet on said legs extending laterally of said beam to provide lateral stability to said beam whereby work surfaces may be cantilevered from said beam.

11. A system as set forth in claim 9 including an electrical wiring passage supported on said beam and including electrical outlets at essentially such work surface height.

12. A system as set forth in claim 11 wherein said wiring passage and said beam together define a section of general T shape.

13. A system as set forth in claim 9 including post support means projecting upwardly from said structural spine, and means to support one or more acoustical panels from said post support means.

14. A system as set forth in claim 13 including frame means extending from said post support means, and means to suspend said acoustical panels from said frame means.

15. A system as set forth in claim 13 wherein said acoustical panels comprise fabric covered sound deadening material.

16. A system as set forth in claim 9 including means vertically to adjust the height of said legs to level and adjust the height of said structural spine.

17. A system as set forth in claim 9 including means to support a plurality of beams extending from a common leg.

18. A system as set forth in claim 9 including passage means in said legs to permit beam-to-beam wiring passage therethrough.

19. A system as set forth in claim 10 including bracket means secured to the top and bottom of said beam to support work surfaces extending in cantilever fashion therefrom.

* * * * *

REEXAMINATION CERTIFICATE (1270th)

United States Patent [19]

Ball et al.

[11] B1 4,224,769

[45] Certificate Issued May 8, 1990

[54] SPACE DIVIDER SYSTEM

[75] Inventors: Douglas C. Ball, Senneville; Marshall Walker, Waterloo, both of Canada

[73] Assignee: Hauserman, Inc., Cleveland, Ohio

Reexamination Request:
No. 90/001,101, Sep. 29, 1986

Reexamination Certificate for:

| | |
|---|---|
| Patent No.: | **4,224,769** |
| Issued: | **Sep. 30, 1980** |
| Appl. No.: | **914,713** |
| Filed: | **Jun. 12, 1978** |

[51] Int. Cl.[5] ..... E04H 1/00

[52] U.S. Cl. ..... 52/36; 52/221; 52/238; 314/140.1

[58] Field of Search ..... 52/36, 221, 238, 239, 52/236.7; 248/224.1, 223.4, 241, 188.7; 312/140.1; 35/60; 211/189

[56] References Cited

U.S. PATENT DOCUMENTS

| | | | |
|---|---|---|---|
| 3,278,149 | 10/1966 | Brucker | 248/241 |
| 3,552,042 | 1/1971 | Rabineau | 35/60 |
| 3,883,202 | 5/1975 | Konig | 312/223 |
| 3,968,882 | 7/1976 | Mello | 211/189 |
| 4,021,973 | 5/1977 | Hegg et al. | 52/36 |
| 4,038,796 | 8/1977 | Eckel | 52/221 |
| 4,056,903 | 11/1977 | Guarnere | 52/122 |
| 4,133,153 | 1/1979 | Hage | 52/220 |

OTHER PUBLICATIONS

Mobili Per Ufficio 1977, published Sep. 1976, pp. I, II, IV, VI 48-51, 83 and 84.

*Primary Examiner*—Carl D. Friedman

[57] ABSTRACT

A space divider system which includes a plurality of posts and at least one beam assembly wherein the posts and beam constitute a raceway for receiving electrical and communication wiring for the transmission of electrical energy at work table height and wherein the posts and beam constitute a rigid structure for supporting various components such as lighting, acoustic panels, table and work surfaces, file storage bins and the like. Means are provided for interconnecting said posts and beam or beams in a manner facilitating the passage of wiring therebetween and addition means are provided within said posts for levelling a beam supported therebetween.

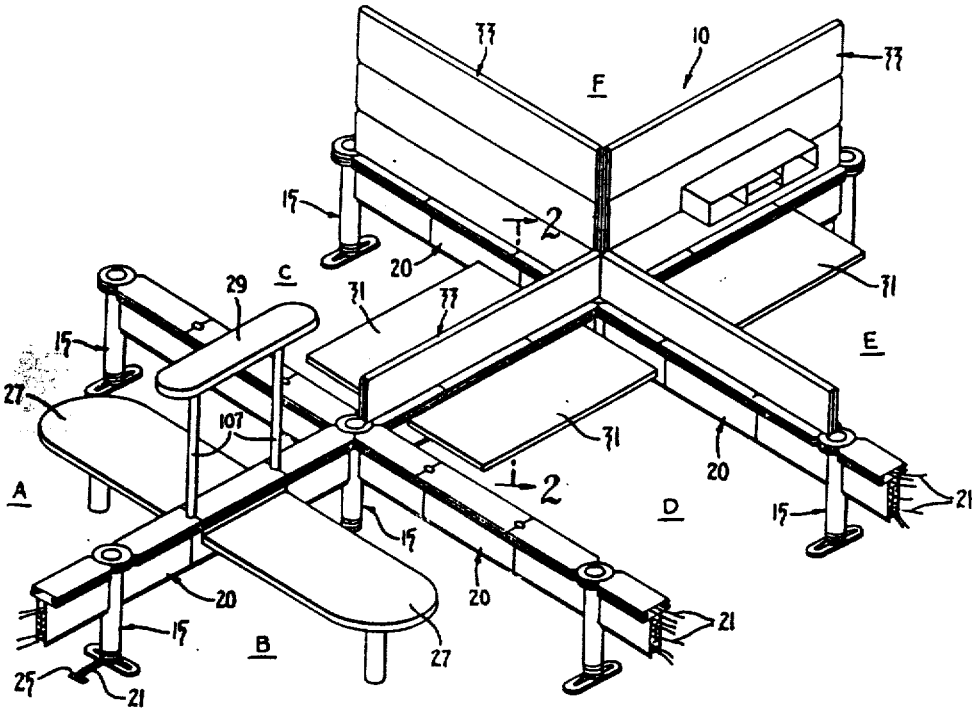

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-2 is confirmed.

Claim 18 is cancelled.

Claims 3, 4, 9, 11 and 12 are determined to be patentable as amended.

Claims 5-8, 10, 13-17 and 19, dependent on an amended claim, are determined to be patentable.

New claims 20-23 are added and determined to be patentable.

3. In a portable space divider system for dividing office areas into small individual task areas, the combination comprising, beam assembly means, a plurality of post assembly means for supporting opposite ends of said beam assembly at approximately work surface height to form a structural spine, means connecting said post assembly means to said beam assembly means, said beam assembly means supporting passage ways to pass electrical and communication wiring therethrough at substantially such work surface height, said post assembly means including height adjustment spindle means for varying the elevation of one end of said beam assembly means relevant to its opposite end, *said post assembly means further including wiring passage means horizontally aligned with the beam assembly passage ways to facilitate post-to-beam and beam-to-beam wiring.*

4. [In the portable space divider system as set forth in claim 3 wherein] *In a portable space divider system for dividing office areas into small individual task areas, the combination comprising, beam assembly means, a plurality of post assembly means for supporting opposite ends of said beam assembly at approximately work surface height to form a structural spine, means connecting said post assembly means to said beam assembly means, said beam assembly means supporting passage ways to pass electrical and communication wiring therethrough at substantially such work surface height, said post assembly means including height adjustment spindle means for varying the elevation of one end of said beam assembly means relevant to its opposite end,* said *beam assembly* [is] *being* in the general form of an I, having a wiring raceway on top of said I and defining therewith a T, and electrical outlet means at substantially work surface height connected to said wiring in said raceway.

9. A space divider system for office interiors comprising a structural spine, said spine including legs, a beam extending therebetween, the top of said beam being at essentially work surface height, and work surfaces and the like extending horizontally from the beam and at least partially supported thereby, *an electrical wiring passage on said beam at essentially such work surface height, and passage means in said legs substantially aligned with the passage on said beam to permit beam-to-beam wiring passage therethrough.*

11. A system as set forth in claim 9 [including an electrical wiring passage supported on said beam and including] *wherein said wiring passage on said beam includes* electrical outlets at essentially such work surface height.

12. [A system as set forth in claim 11 wherein] *A space divider system for office interiors comprising a structural spine, said spine including legs, a beam extending therebetween, the top of said beam being at essentially work surface height, work surfaces and the like extending horizontally from the beam and at least partially supported thereby, and an electrical wiring passage supported on said beam and including electrical outlets at essentially such work surface height,* said wiring passage and said beam together [define] *defining* a section of general T shape.

*20. A space divider system for office interiors comprising a structural spine, said spine including legs, a beam extending therebetween, the top of said beam being at essentially work surface height, work surfaces and the like extending horizontally from the beam and at least partially supported thereby, bracket means supporting said work surfaces, means securing said bracket means to said beam, and means adjustably to shift said bracket means and thus said work surfaces along the length of said beam, said bracket means including means to fix said work surfaces at a desired elevation with respect to said beam.*

*21. A space divider system as set forth in claim 20 wherein said bracket means is a cantilever bracket and engages top and bottom portions of said beam.*

22. A space divider system for office interiors comprising a structural spine, said spine including legs, a beam extending therebetween, the top of said beam being at essentially work surface height, work surfaces and the like extending horizontally from the beam and at least partially supported thereby, an electrical wiring passage on said beam at essentially such work surface height, and passage means in saidlegs substantially alinged with the passage on said beam to permit beam-*to-beam wiring passage therethrough, bracket means supporting said work surfaces, means securing said bracket means to said beam, and means adjustably to shift said bracket means and thus said work surfaces along the length of said beam, said bracket means including means to fix said work surfaces at a desired elevation with respect to said beam.*

*23. A space divider system as set forth in claim 22 wherein said bracket means is a cantilever bracket and engages top and bottom portions of said beam.*

* * * * *